US008974604B2

(12) United States Patent
Baziuk

(10) Patent No.: US 8,974,604 B2
(45) Date of Patent: Mar. 10, 2015

(54) SEWER CLEANING METHOD

(76) Inventor: Slawko Morris Baziuk, Winnipeg (CA)

( * ) Notice: Subject to any disclaimer, the term of this patent is extended or adjusted under 35 U.S.C. 154(b) by 669 days.

(21) Appl. No.: 12/817,258

(22) Filed: Jun. 17, 2010

(65) Prior Publication Data

US 2011/0308552 A1 Dec. 22, 2011

(51) Int. Cl.
*B08B 9/00* (2006.01)
*B08B 9/043* (2006.01)

(52) U.S. Cl.
CPC ..... *B08B 9/0433* (2013.01)
USPC ..... 134/22.12; 134/22.1; 134/23; 134/24; 134/32

(58) Field of Classification Search
USPC ..... 134/22.12, 22.1, 23, 24, 32
See application file for complete search history.

(56) References Cited

U.S. PATENT DOCUMENTS

| | | | | |
|---|---|---|---|---|
| 3,321,184 | A * | 5/1967 | Goss | 254/134.4 |
| 3,380,461 | A | 4/1968 | Maasberg | |
| 3,678,948 | A | 7/1972 | Hedges | |
| 3,814,330 | A | 6/1974 | Masters | |
| 4,073,302 | A | 2/1978 | Jones | |
| 4,326,893 | A * | 4/1982 | Clifford | 134/8 |
| 4,337,096 | A * | 6/1982 | Clifford | 134/8 |
| 4,382,581 | A * | 5/1983 | Wimer et al. | 254/134.3 FT |
| 4,699,163 | A | 10/1987 | Baziuk | |
| 4,718,142 | A * | 1/1988 | Wahlers | 15/395 |
| 4,993,443 | A * | 2/1991 | Buchert | 134/167 C |
| 5,068,940 | A * | 12/1991 | Sheppard et al. | 15/104.31 |
| 5,069,722 | A * | 12/1991 | Murphy | 134/22.11 |
| 5,419,496 | A * | 5/1995 | Novak, Jr. | 239/530 |
| 5,435,854 | A * | 7/1995 | Derlein | 134/22.11 |
| 5,444,887 | A * | 8/1995 | Rufolo | 15/104.31 |
| 5,622,571 | A * | 4/1997 | Derlein | 134/22.11 |
| 5,638,844 | A * | 6/1997 | Szekeres | 134/167 C |
| 5,720,309 | A * | 2/1998 | Baziuk | 134/167 C |
| 6,089,243 | A * | 7/2000 | Horger et al. | 134/167 C |
| 6,099,657 | A * | 8/2000 | Boyer | 134/8 |
| 6,138,697 | A * | 10/2000 | Horger et al. | 134/167 C |
| 6,494,437 | B1 * | 12/2002 | Boyer | 254/323 |
| 6,508,261 | B1 * | 1/2003 | Nezat, II | 134/167 C |
| 6,527,869 | B1 * | 3/2003 | Bourg | 134/1 |
| 6,604,536 | B1 * | 8/2003 | Davey et al. | 134/104.2 |
| 6,764,604 | B1 * | 7/2004 | Nezat, II | 210/800 |
| 7,267,133 | B1 * | 9/2007 | Nezat, II | 134/166 C |
| 7,306,000 | B1 * | 12/2007 | Nezat, II | 134/166 C |
| 2010/0147753 | A1 * | 6/2010 | Baziuk | 210/126 |

* cited by examiner

*Primary Examiner* — Michael Kornakov
*Assistant Examiner* — Katelyn Whatley
(74) *Attorney, Agent, or Firm* — Adrian D. Battison; Ade & Company Inc.

(57) ABSTRACT

A sewer pipe is cleaned of collected solids by providing a water supply hose at a first location on the pipe and by driving a jet nozzle head to a second location along the pipe using jets directed along the pipe. At the second location the head is changed for a second head attached to a cable and is pulled back to the first location by the hose. The nozzle is then pulled back to the second location by pulling the cable while nozzles directed along the pipe toward the second location drive the solids forwardly to the second location for extraction.

3 Claims, 3 Drawing Sheets

SEWER CLEANING METHOD

This invention relates to a method for cleaning sewer drains using a jet nozzle system which carries collected solids to a discharge points for extraction.

BACKGROUND OF THE INVENTION

Examples of systems of this type are shown in U.S. Pat. Nos. 4,699,163 and 5,720,309 (issued Feb. 24, 1998) both of the present inventor which includes an elongate pipe section having a rear end for connection to the hose and a forward end connected to a cylindrical housing. At a rear face of the housing is provided a plurality of rearwardly extending jets surrounding the pipe section. A plurality of skid bars are attached to the housing longitudinally of the housing at angularly spaced positions around the housing with those skid bars extending from the rear face of the housing rearwardly and inwardly for attachment to the pipe section.

Further examples are shown in U.S. Pat. No. 3,380,461 (Maasberg), U.S. Pat. No. 3,678,948 (Hedges assigned to Rockwell Manufacturing Co.); U.S. Pat. No. 3,814,330 (Masters assigned to McNeil Corporation) and U.S. Pat. No. 4,073,302 (Jones).

Masters shows a nozzle having four lobes each lying in a substantially axial plane with the lobes arranged at right angles and each lobe carries two jet nozzles. This arrangement is disadvantageous in that the nozzles are carried on the lobes and therefore can be engaged into the material at the base of the pipe thus reducing flow.

Maasberg discloses a head which is generally a flat body with nozzles at the front face. Again the nozzles can engage into the material reducing flow.

Hedges discloses a relatively complex arrangement with two heads carried on a central fin section with the fins welded to a connecting pipe section at spaced positions around the axis of the pipe section. This arrangement is relatively complex and bulky so that the cost of manufacture is increased and the proper flow of material and flushing water may not be achieved.

Jones discloses an arrangement with skids which run on the inside surface of the pipe with a simple nozzle and is therefore carried centrally of the pipe. This arrangement is impractical in view of the difficulty of running along the length of the pipe which can have obstructions, bends and the like.

SUMMARY OF THE INVENTION

It is one object of the invention to provide an improved sewer cleaning method.

According to one aspect of the invention there is provided a method for cleaning a sewer pipe of collected solid materials comprising:

providing access to the pipe at first and second longitudinally spaced locations;

providing at the first location a hose system including a hose supply and pulling device for releasing and withdrawing the hose system and a cleaning liquid supply system for supplying cleaning liquid to the hose system;

providing at the second location a pulling system including a cable and a device for releasing and pulling in the cable;

providing at the second location an extraction system for extracting solid materials drawn to the second location;

in a first step at the first location, attaching the hose system to a first jet nozzle head and causing the first jet nozzle head with the hose system attached to move from the first location to the second location by directing the liquid from the first jet nozzle head toward the first location so that the flow of liquid acts to drive the first jet nozzle head along the pipe toward the second location while pulling the hose system along the pipe;

in a second step, withdrawing the hose system to the first location with the cable attached so as to pull the cable to the first location; and in a third step, with the cable and the hose system attached to a second jet nozzle head, pulling the cable back toward the second location to cause the second jet nozzle head to move from the first location to the second location with the hose system pulled behind the second jet nozzle head from the first location while directing the cleaning liquid from the second jet nozzle head toward the second location so that the flow of cleaning liquid acts to drive the solid materials along the pipe to the second location for extraction at the second location.

As will be appreciated by a person skilled in this art, the term "cable" used herein can include other pulling elements such as cord, string, chain to be wound onto a winch. However it is intended that the cable does not act as a liquid supply so that it is not a hose.

In this way the cable or pulling element has only a small diameter less than that of supply hose so that it does not interfere with the cleaning of the pipe. The hose system supplying the cleaning liquid to the second head is pulled behind the head in the cleaned pipe so that it does not interfere with the movement of the movement of the second head in the pipe or the movement of the solids and liquid in the pipe in front of the second head.

In the third step the hose supply system can include a plurality of hoses for supplying a high quantity of liquid. As these hoses are pulled behind the second head the number and bulk of the additional hoses does not interfere with the cleaning action. In this way the level of liquid can be maintained very high to provide the best cleaning action.

As the second cleaning head is designed without necessity for considering the function of carrying the head through the pipe in the first step, it allows the design to be arranged which maximizes the cleaning effect.

In the first step the first head generally will be attached to a single hose for supplying a sufficient quantity of liquid only to transport the jet nozzle system to the second location.

BRIEF DESCRIPTION OF THE DRAWINGS

One embodiment of the invention will now be described in conjunction with the accompanying drawings in which.

In the drawings like characters of reference indicate corresponding parts in the different figures.

DETAILED DESCRIPTION

Figure 1:
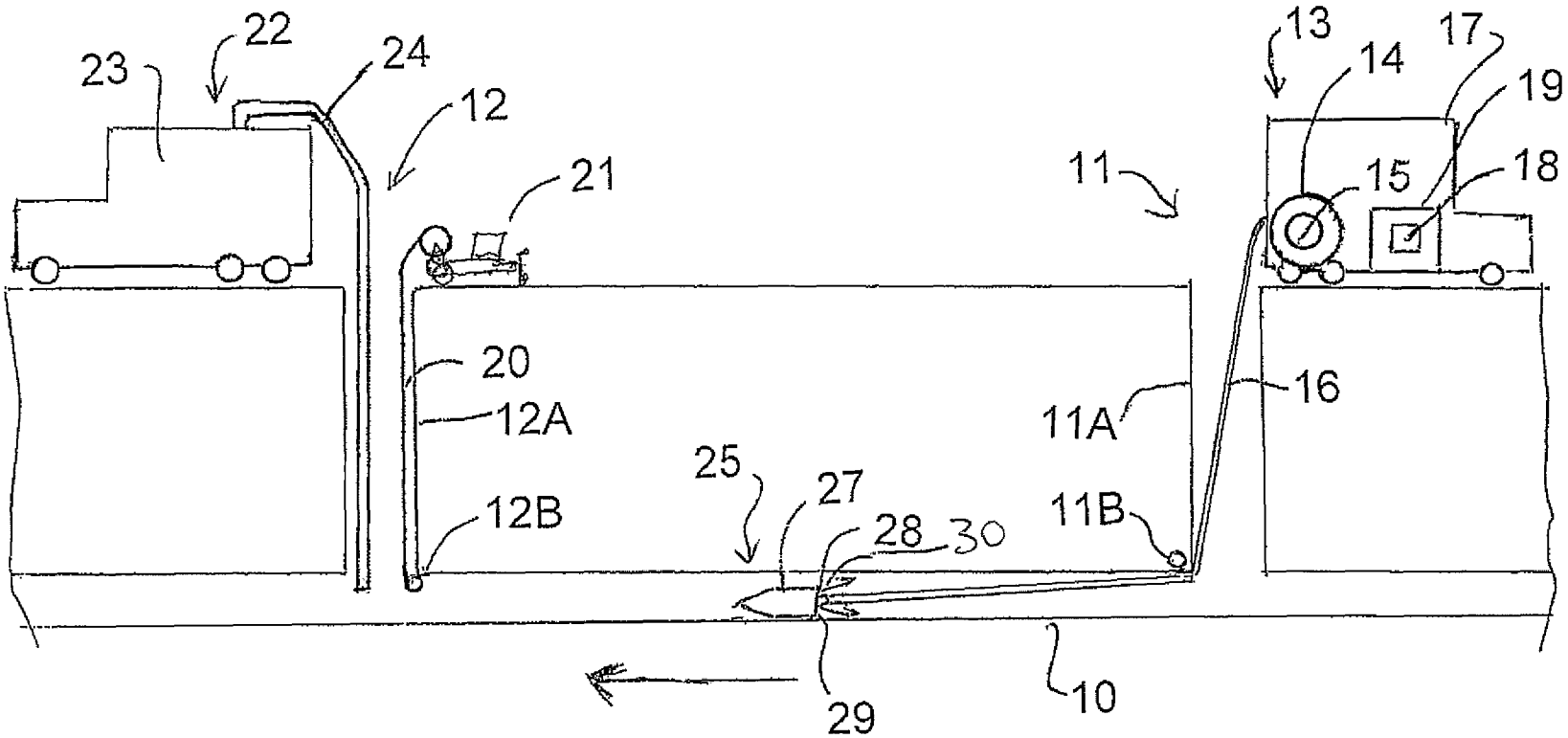
FIGS. 1, 2 and 3 show schematically three steps in the process according to the present invention.
Figure 2:
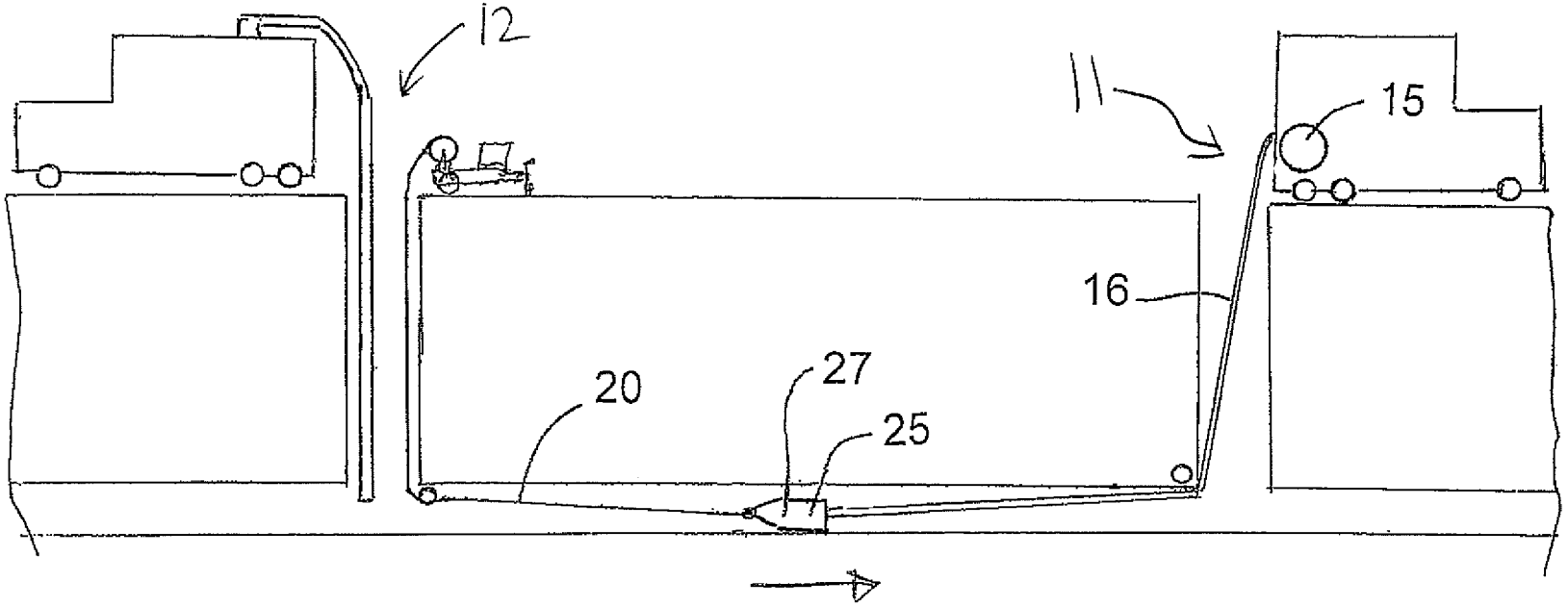
Figure 3:
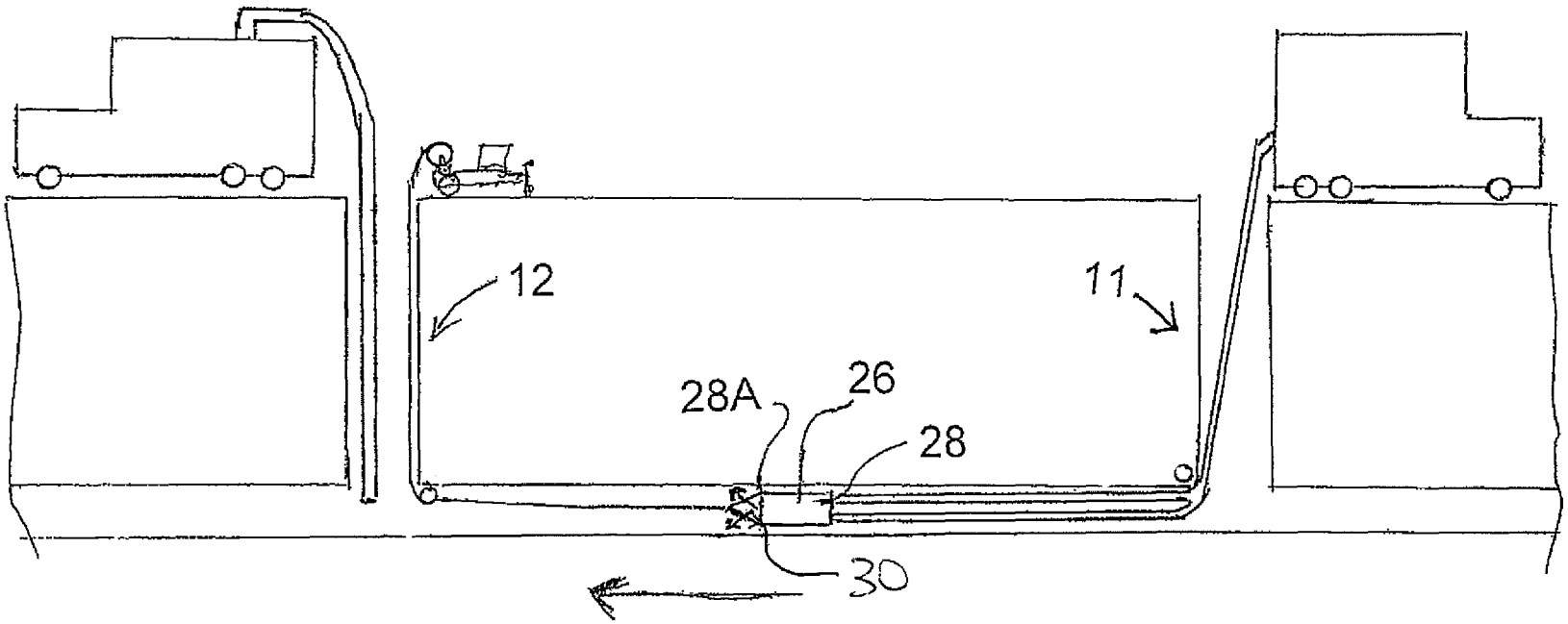

A method for cleaning a sewer pipe of collected solid materials using an apparatus designed for the method is shown in FIGS. 1 to 3.

The method is used with a pipe 10 to be cleaned of collected debris including sand, gravel, sticks and other material which can enter such pipes add tends to settle along the length of the pipe. Such pipes for use with the method described herein are typically of a large diameter, greater than 24 inches since such pipes are much more difficult to clean so that the method described provides an enhanced cleaning action. However there is no limit on the size of pipe to be cleaned.

Access to the pipe is provided at a first location 11 and at a second longitudinally spaced location 12. These are typically pre-constructed openings with vertical access to the ground and are spaced along the pipe at convenient intervals to grant suitable access for cleaning, repair and inspection.

At the first location 11 is provided a hose system 13 including a hose supply 14 mounted on a reel 15 acting as a pulling device for releasing and withdrawing the hose 16. The reel and hose supply are mounted in a jet truck 17 with a cleaning liquid supply system including a pump 18 and a tank 19 for supplying cleaning liquid, generally water, to the hose system. Jet trucks of this type are well known and widely used in the pipe cleaning business so that no further detail is required here. As shown in the figures there is a single truck illustrated supplying a single hose 16. However more than one truck can be provided in most cases to supply a larger quantity of liquid through additional hoses.

At the second location 12 is provided a pulling system including a cable 20 and a winch 21 for releasing and pulling in the cable 20. Also at the second location is provided an extraction system 22 including a vacuum truck 23 and a vacuum hose 24 attached thereto for extracting solid materials out of the vertical access pipe 12A at the second location. Vacuum trucks of this type are well known and widely used in the pipe cleaning business so that no further detail is required here.

The system further includes a first jet nozzle head 25 for use in a first step of the method and a second jet nozzle head 26 for use in a second step of the method. Each of these heads is of the type generally shown in one or more of the above patents, the disclosures of which are incorporated herein by reference. Thus each head includes a body 27 which can slide along the pipe with a connection 28 to a hose 16 and one or more nozzles 30. A typical example is shown in the figures of U.S. Pat. No. 4,499,163 referenced above. The body may include skids which enhance its movement along the pipe.

At each of the first and second locations is provided a guide roller 11B, 12B for guiding the movement of the cable 20 and the hoses from the vertical section 11A, 12A into the pipe In a first step shown in FIG. 1, at the first location 11, the hose 16 from the truck 17 is attached to the first jet nozzle head 25 with the hose system attached to the rear of the head with the jet nozzles 29 arranged to direct the liquid rearwardly toward the first location 11. This causes the head to move from the first location 11 along the pipe to the second location 12 by directing the liquid from the first jet nozzle head toward the first location 11 so that the flow of liquid acts to drive the first jet nozzle head along the pipe toward the second location 12 while pulling the hose 16 along the pipe. The head can be of a simple construction since its only function is to drive along the pipe with no cleaning action being required.

In a second step shown in FIG. 2, at the second location 12, the cable 20 is attached to the head 25 and the hose system 15 is withdrawn by winding the hose 16 onto the reel 15 so that the head 25 is pulled back to the first location 11 with the cable 20 attached so as to pull the cable 20 to the first location 11. The head 25 can alternatively be removed at the second location 12 and the cable 20 attached directly to the hose 16 at a forward end coupling. In a yet further alternative, the head 25 can be removed at the second location 12 and replaced by the second head 26 (shown in FIG. 3). It will be appreciated that the function of the second step is to carry the cable 20 to the first location 11 and hence the presence or absence of the heads 25 or 26 is of little importance.

In a third step shown in FIG. 3, the cable 20 and the hose system are attached to the second head 26 which is then pulled by the cable 20 back toward the second location 12. In this step, the second head 26 is arranged with the nozzles 28A facing toward the second location 12. The head is attached to the hose 16 which extends from the head to the location 11 and thus drags behind the head in the cleaned pipe as the head is pulled forwardly to the second location 12. One or more additional hoses 16A fed from additional jet trucks can be provided from the location 11 into the pipe to supply additional cleaning liquid to ensure sufficient flow to provide an effective cleaning action.

The head 26 is thus pulled from the first location 11 to the second location 12 with the hose system pulled behind the head extending to the first location. The nozzles 28A act to direct the cleaning liquid from the head toward the second location 12 so that the flow of cleaning liquid acts to drive the solid materials along the pipe to the second location 12 for extraction at the second location 12 by the vacuum system 22.

As the pipe in front of the head as it moves is unencumbered by thick hoses, the cleaning action can be more effective.

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for cleaning a sewer pipe of collected solid materials comprising:

providing access to the pipe at first and second longitudinally spaced locations;

providing at the first location a hose system including a hose supply and pulling device for releasing and withdrawing the hose system and a cleaning liquid supply system for supplying cleaning liquid to the hose system;

providing at the second location a pulling system including a cable and a device for releasing and pulling in the cable;

providing at the second location an extraction system for extracting solid materials drawn to the second location;

in a first step at the first location, attaching the hose system to a first jet nozzle head and causing the first jet nozzle head with the hose system attached to move from the first location to the second location by directing the liquid from the first jet nozzle head toward the first location so that the flow of liquid acts to drive the first jet nozzle head along the pipe toward the second location while pulling the hose system along the pipe;

in a second step, attaching the cable and withdrawing the hose system to the first location with the cable attached so as to pull the cable to the first location; and in a third step, attaching a second jet nozzle head to the hose system and with the cable and the hose system attached to the second jet nozzle head, pulling the cable back toward the second location to cause the second jet nozzle head to move from the first location to the second location with the hose system pulled behind the second jet nozzle head from the first location while directing the cleaning liquid from the second jet nozzle head toward the second location so that the flow of cleaning liquid acts to drive the solid materials along the pipe to the second location for extraction at the second location.

2. The method according to claim 1 wherein, in the third step, the hose supply system includes a plurality of hoses.

3. The method according to claim 1 wherein, in the first step the first jet nozzle head is attached to a single hose.

* * * * *